US008371073B2

(12) United States Patent
Fuller

(10) Patent No.: US 8,371,073 B2
(45) Date of Patent: Feb. 12, 2013

(54) BUILDING WITH INTEGRATED NATURAL SYSTEMS

(75) Inventor: Michael B. Fuller, Basalt, CO (US)

(73) Assignee: Michael Fuller Architects, PC, Basalt, CO (US)

( * ) Notice: Subject to any disclaimer, the term of this patent is extended or adjusted under 35 U.S.C. 154(b) by 0 days.

(21) Appl. No.: 12/717,762

(22) Filed: Mar. 4, 2010

(65) Prior Publication Data

US 2011/0214364 A1 Sep. 8, 2011

(51) Int. Cl.

| | |
|---|---|
| ***E04H 14/00*** | (2006.01) |
| ***E04D 13/18*** | (2006.01) |
| ***E04F 17/00*** | (2006.01) |
| ***E04B 1/342*** | (2006.01) |

(52) U.S. Cl. ..... 52/80.1; 52/173.3; 52/234; 52/473

(58) Field of Classification Search ..... 52/81.6, 52/80.1, 236.2, 236.6, 236.7, 236.9, 106, 52/173.3, DIG. 17, 473, 22, 236.3, 234; 47/17, 47/19.1, 19.2

See application file for complete search history.

(56) References Cited

U.S. PATENT DOCUMENTS

| | | | | | |
|---|---|---|---|---|---|
| 1,883,764 | A | * | 10/1932 | Collins | 607/95 |
| 2,914,074 | A | * | 11/1959 | Fuller | 135/124 |
| 3,354,591 | A | * | 11/1967 | Fuller | 52/81.2 |
| 3,768,754 | A | * | 10/1973 | Janes | 244/171.8 |
| 3,872,911 | A | * | 3/1975 | Janes | 160/1 |
| 3,981,294 | A | | 9/1976 | Deminet et al. | |
| 4,000,850 | A | | 1/1977 | Diggs | |
| 4,011,697 | A | | 3/1977 | Fedolfi | |
| 4,028,854 | A | | 6/1977 | Diggs | |
| 4,033,081 | A | | 7/1977 | Perkins, Jr. | |
| 4,049,195 | A | * | 9/1977 | Rugenstein | 126/591 |
| 4,132,356 | A | | 1/1979 | Ramer | |
| 4,137,901 | A | | 2/1979 | Maier | |
| 4,141,498 | A | * | 2/1979 | Marschner | 237/1 R |
| 4,192,454 | A | * | 3/1980 | Rugenstein | 126/592 |
| 4,206,575 | A | | 6/1980 | Leonard | |
| 4,217,742 | A | * | 8/1980 | Evans | 52/553 |
| 4,228,788 | A | * | 10/1980 | Moeser | 123/437 |
| 4,245,621 | A | | 1/1981 | Hollobaugh | |
| D260,436 | S | | 8/1981 | Graybeal et al. | |

(Continued)

FOREIGN PATENT DOCUMENTS

| | | | |
|---|---|---|---|
| DE | 10353544 B3 | * | 9/2005 |
| JP | 04024376 A | * | 1/1992 |

(Continued)

*Primary Examiner* — Basil Katcheves
*Assistant Examiner* — Rodney Mintz
(74) *Attorney, Agent, or Firm* — Sheridan Ross PC

(57) ABSTRACT

A building is provided with integrated natural systems that reduce dependency on external resources to operate and maintain the building. A source of electricity is provided through an extensive set of solar panels that may be incorporated on louvers mounted to the exterior of the building. The building has a double insulative layer to include an outer airtight membrane or cover, and an internal building structure that defines habitable space within the structure. Rainwater may be collected and stored within a subsurface well. The space between the internal structure and outer membrane may support the growth of vegetation in a greenhouse environment. A flow of temperature regulated air is provided through the structure by a set of underground pipes in which the air is circulated through a central core of the building, into the habitable space, and then outward into the greenhouse space.

16 Claims, 9 Drawing Sheets

U.S. PATENT DOCUMENTS

| | | | | | |
|---|---|---|---|---|---|
| D260,437 | S | | 8/1981 | Graybeal et al. | |
| D261,037 | S | | 9/1981 | Schlageter et al. | |
| 4,291,674 | A | * | 9/1981 | Comte et al. | 126/592 |
| D262,058 | S | | 11/1981 | Graybeal et al. | |
| 4,329,919 | A | | 5/1982 | Andersen | |
| 4,351,320 | A | | 9/1982 | Tetirick | |
| 4,385,625 | A | | 5/1983 | Lee | |
| 4,407,028 | A | | 10/1983 | Nolan | |
| 4,409,960 | A | * | 10/1983 | Balzer | 126/633 |
| 4,442,826 | A | | 4/1984 | Pleasants | |
| 4,458,669 | A | | 7/1984 | Lee | |
| 4,515,150 | A | | 5/1985 | McGlew et al. | |
| 4,594,470 | A | * | 6/1986 | Headrick | 136/246 |
| 4,625,961 | A | | 12/1986 | Brand | |
| 4,644,320 | A | | 2/1987 | Carr et al. | |
| 4,644,716 | A | | 2/1987 | Neuroth | |
| 4,668,841 | A | * | 5/1987 | Headrick | 136/246 |
| 4,837,989 | A | * | 6/1989 | Levy | 52/27 |
| 4,899,728 | A | | 2/1990 | Peter et al. | |
| 4,934,338 | A | | 6/1990 | Hollick et al. | |
| 4,956,936 | A | * | 9/1990 | Sprung | 47/17 |
| 5,341,610 | A | * | 8/1994 | Moss | 52/82 |
| 5,483,774 | A | * | 1/1996 | Siemerink et al. | 52/81.2 |
| 5,524,381 | A | | 6/1996 | Chahroudi | |
| 5,536,395 | A | | 7/1996 | Kuennen et al. | |
| 5,544,036 | A | | 8/1996 | Brown, Jr. et al. | |
| 5,645,248 | A | * | 7/1997 | Campbell | 244/30 |
| 5,761,083 | A | | 6/1998 | Brown, Jr. et al. | |
| 6,131,363 | A | * | 10/2000 | Phillips | 52/786.11 |
| 6,351,130 | B1 | | 2/2002 | Preiser et al. | |
| 6,408,644 | B1 | | 6/2002 | Williams | |
| 6,538,796 | B1 | * | 3/2003 | Swanson | 359/291 |
| 6,819,760 | B1 | | 11/2004 | Nayler | |
| 6,832,452 | B1 | * | 12/2004 | Simens | 52/6 |
| 7,032,588 | B2 | | 4/2006 | Hollick | |
| 7,190,531 | B2 | | 3/2007 | Dyson et al. | |
| 7,210,312 | B2 | | 5/2007 | Unger | |
| 7,292,908 | B2 | | 11/2007 | Borne et al. | |
| 7,389,157 | B2 | | 6/2008 | Loyd et al. | |
| 7,444,782 | B2 | | 11/2008 | Crowell | |
| 7,555,658 | B2 | | 6/2009 | Vahid et al. | |
| D596,313 | S | | 7/2009 | Perrine | |
| 7,561,977 | B2 | | 7/2009 | Horst et al. | |
| 7,574,505 | B2 | | 8/2009 | Park et al. | |
| 8,024,891 | B2 | * | 9/2011 | Maria Ruiter | 47/17 |
| 8,028,691 | B2 | * | 10/2011 | Maxson et al. | 126/702 |
| 8,215,066 | B2 | * | 7/2012 | Hosking et al. | 52/66 |
| 2005/0210767 | A1 | * | 9/2005 | DeFever et al. | 52/80.1 |
| 2006/0059772 | A1 | * | 3/2006 | Brault et al. | 47/17 |
| 2008/0163562 | A1 | * | 7/2008 | Conant | 52/16 |
| 2008/0229704 | A1 | * | 9/2008 | Augustyniak et al. | 52/782.1 |
| 2009/0032089 | A1 | * | 2/2009 | Chen et al. | 136/251 |
| 2009/0049763 | A1 | * | 2/2009 | Blundell et al. | 52/81.1 |
| 2009/0183764 | A1 | * | 7/2009 | Meyer | 136/246 |
| 2009/0255568 | A1 | * | 10/2009 | Morgan | 136/246 |
| 2009/0301399 | A1 | * | 12/2009 | Brown et al. | 119/226 |
| 2009/0320388 | A1 | * | 12/2009 | Lilli et al. | 52/173.3 |
| 2010/0300010 | A1 | * | 12/2010 | Vallejo | 52/30 |
| 2011/0023937 | A1 | * | 2/2011 | Daniel et al. | 136/246 |
| 2011/0146166 | A1 | * | 6/2011 | Noble | 52/167.1 |
| 2011/0167737 | A1 | * | 7/2011 | Wu | 52/64 |
| 2012/0131858 | A1 | * | 5/2012 | Hosking et al. | 52/6 |
| 2012/0131859 | A1 | * | 5/2012 | Hosking et al. | 52/6 |
| 2012/0131860 | A1 | * | 5/2012 | Hosking et al. | 52/8 |
| 2012/0131861 | A1 | * | 5/2012 | Hosking et al. | 52/8 |
| 2012/0135673 | A1 | * | 5/2012 | Hosking et al. | 454/199 |
| 2012/0174478 | A1 | * | 7/2012 | Chen et al. | 47/17 |

FOREIGN PATENT DOCUMENTS

| | | | |
|---|---|---|---|
| JP | 2003221896 | A * | 8/2003 |

* cited by examiner

BUILDING WITH INTEGRATED NATURAL SYSTEMS

FIELD OF THE INVENTION

The present invention relates to buildings that incorporate natural systems to cool, heat, ventilate, collect and purify water, and generate power for operation of the building. More particularly the invention relates to a building that integrates these natural systems in a sustainable, functional and economical manner.

BACKGROUND OF THE INVENTION

The use of solar power has become quite common as a means to provide power for man-made structures to include both residential and commercial buildings. With the increased cost of energy from traditional sources such as fossil fuels, coupled with a transition in industry towards eco-friendly or "green" technologies, building architectures and designs continue to evolve to incorporate solar power systems.

Solar panel arrays are often installed on existing buildings. In most cases, the solar panels are mounted on the roof of the building, and therefore are limited in terms of the amount of solar panels that can be used to produce power. When land is available, an increased number of solar panel arrays can be situated at a location adjacent the building(s) to be powered, however increasing solar panels in this manner is not a viable solution for powering buildings within most cities.

In extreme climate conditions such as desert or arctic environments, solar power can be a useful means of power generation for a building; however, other traditional power sources typically have to be included to supplement shortcomings with the solar power supply. For example, it is rare that a solar panel array in a larger building located in a desert climate will be capable of powering high energy consumption cooling systems, such as the building's HVAC systems. Similarly, in colder climates, while solar panels may provide enough power for electrical lighting, it is uncommon for solar panels to be able to produce enough energy to effectively heat the building.

There are a great number of patents that disclose solar panel systems to include those that are incorporated on buildings. One example is found in the U.S. Pat. No. 5,524,381. This reference discloses a building including a high efficiency transparent insulation and optical shutter solar collector to effectively control heat loss and gain in a passive solar climate control system. This invention also includes a layer of protective glazing, a transparent insulation, an optical shutter, an optional solar radiation absorbing material, and an optional heat storage element. When the building and its heat storage are too warm, the optical shutter layer becomes opaque to prevent overheating. During cloudy and cold days, the system still has a solar transmission and insulation efficiency great enough to collect sufficient sunlight for heating.

Although there are a number of existing systems for providing power, cooling, heating and ventilating for a building structure, there is still a need to provide a building which can more efficiently incorporate these systems in a very functional, but yet aesthetically pleasing design. There is also a need to increase the surface area available for mounting of solar panels without requiring adjacent land for a separate solar power generation area.

There is also a need for a building to have the capability to react to changing weather conditions to include sun angles and daily temperature shifts. There is also a need to provide passive cooling and heating to regulate the temperature of the building, and this passive system being independently controlled as compared to the power generation system of the building. Further, there is a need to provide a building in which a significant greenhouse space or area is available for growing vegetation that not only enhances the interior décor of the building, but also can be a space large enough to accommodate other plant uses such as fruits and vegetables that can be consumed by the inhabitants of the building.

There is also a need to integrate natural systems in the design of a building that can create a more pleasant livable place. It has been shown that incorporating elements from nature has many benefits to include enhancing productivity, reducing the number of sick days in the workplace, promoting learning in schools, and shortening recovery times in hospitals.

Finally, there is a need to incorporate other natural systems in a building to create a building that is more sustainable in terms of not having to rely upon traditional utilities, these other natural systems including the collection of rainwater and recycling of the collected water for re-use within the building.

SUMMARY OF THE INVENTION

The present invention provides a building with integrated natural systems to perform a number of sustainable functions for the building to include cooling, heating, ventilating, and the production of electricity to power the building. Additional sustainable functions include the collection of rainwater for various uses and treatment of waste water for re-use in the building. The collected water is used for many building functions including potable drinking water, and non-potable grey water applications such as bathroom water and irrigation. The collected water can be purified to desired levels for both non-potable and potable water uses.

One general functional aspect of the present invention is to provide a building that is designed to respond to changing sun and weather conditions in order to provide the most efficient heating and cooling for the building. It is yet another aspect of the present invention to provide a building that takes advantage of natural systems to produce functional requirements of the building and therefore the building's functions can be characterized as taking advantage of bio-mimicry to solve functional requirements.

In a preferred embodiment of the present invention, a dual exterior cover construction is provided, along with a plurality of louvers that are mounted on the most exterior cover/covering. The outer covering is preferably in the form of a transparent or translucent membrane that allows sunlight to pass through, thus creating an interior greenhouse space within the membrane. The louvers provide a number of functions to include shade and power generation by the incorporation of photovoltaic cells on all or selected louvers. The louvers are adjustable to track the path of the sun, or may otherwise be controlled to selectively capture sunlight and/or to shade the underlying interior structure. In general, the dual exterior cover construction with the mounted louvers and the interior building components work together as an integrated natural system to provide power generation, passive cooling and heating, natural and supplemented lighting conditions, and an interior greenhouse space for growing plants.

The inner wall of the dual exterior cover construction comprises the structural exterior of the living space of the building. The gap between the inner walls and the exterior cover is available as a greenhouse space to cultivate plants. This greenhouse space also serves as an insulating barrier for more efficient regulation of the temperature within the living space.

The components of the interior building system include an interior habitable space with one or more floors. The room spaces on each floor may include movable interior walls that can be adjusted by the user. A central open area provides a thermal mass of air for heating/cooling of the habitable space. A well containing a supply of water is positioned centrally within the building, and the water is continually re-circulated. A controlled temperature air supply is provided to ventilate the building and otherwise provide a fresh air supply. The air supply passes through subterranean passages that communicate with water from the well, and the air supply then flows through the central mass to heat or cool the habitable space. Humidification of the air can be achieved by contact of the air supply with the water. Alternatively, the subterranean passages can be isolated from the well in order to de-humidify the air.

The louvers are positioned on the exterior cover which, in the preferred embodiment, has a compound curved-shape thereby affording an increased area for mounting of the louvers to produce power. Additionally, this curved-shaped exterior cover provides a natural gap or space between the interior structure that has vertical walls. The louvers are selectively positioned to capture sunlight and/or provide shading. Additionally, it is contemplated that the louvers could also include material which reflects sunlight, in which the louvers could be positioned to thereby direct sunlight to the interior structure for lighting purposes.

The subterranean air supply flows through an underground system of passageways such as pipes that will pre-cool or preheat the outside air source, depending upon ambient temperature conditions. The fresh air enters the building core through the foundation and is forced into the central open area within the interior building structure. The air is then distributed through the interior building through floor plenums that communicate with the central thermal mass. Optionally, the air may communicate with the water in the well, which provides humidification for the incoming air.

Air is allowed to circulate through the interior habitable space, and may be vented into the greenhouse space. Air within the green house space may be circulated by one or more mechanical fans. Air is evacuated from the building through vents located near the apexes of the exterior cover. A natural circulation pattern develops as air is warmed in the greenhouse space such that an upward circulation or flow is created. Accordingly, forced air requirements are reduced as compared to most traditional building spaces.

The exterior cover construction includes a relatively thin film of transparent or translucent material, such as a polymer which can be molded into a desired shape. One example of a polymer that can be used includes ethylenetetraflowro-ethylene (ETFE). The exterior cover or skin is supported by an underlying aluminum frame which generally conforms to the shape of the exterior cover/skin. The aluminum frame provides adequate support against loading conditions such as wind/snow. Although relatively thin and transparent, the skin provides protection for the interior structure. Vents are located in the apex of the exterior cover/skin as mentioned in order to allow a continual circulation of air through the greenhouse space.

The louvers are mounted to the exterior cover so that the louvers can be rotated along at least one axis in order to track the path of the sun, or otherwise provide the ability to adjustably place the louvers for optimal sunlight capture, shading, or reflection of light into the interior structure.

With respect to the interior building construction, the central thermal mass is defined as an internal central tower made of thickened masonry walls, and further including a subterranean extension that incorporates the well. The interior building structure may include a single floor or multiple floors. The support superstructure of the building may comprise steel and/or concrete constructions. One specific example of an interior building floor system that may be adopted includes a steel superstructure with concrete floor slabs supported by steel posts and beams. The enclosing walls at the perimeter of the floor system may be frame construction supported by the floor system, or curtain wall construction attached to the exterior of the floor system and supported by the steel superstructure. Optionally, the enclosing walls of the interior structure may have operable glass panels, doors and windows that open to the greenhouse space.

The central tower includes a plurality of openings creating walkways between opposite sides of the superstructure. Windows may also be formed in the central tower enabling air and light to readily pass between opposite sides of the structures. The living space of the building is preferably arranged in two sections located on opposite sides of the central tower. The living space may include one or more floors.

Preferably, the well located on the ground floor, receives collected rainwater for storage, and the water is continuously circulated by pumps in the well to humidify the air.

Planter boxes and planting platforms may be attached at each floor level as by steel beams that extend beyond the concrete floor slabs. A drip irrigation system can also be provided to water the planted areas, and this drip irrigation system uses collected rainwater stored in the well. A relatively large garden area may be provided on the roof of the interior structure, and may be referred to as an arboretum. The arboretum is also structurally supported by reinforced steel beams located on the roof and capable of carrying the additional weight of the soil that is used for planting. A waterproof liner is used to keep the lower levels dry in the event the structure is built with multiple floors.

It is also contemplated that external water collection can be achieved by a system of rain collecting troughs or/channels to catch rainfall that strikes the louvers. The louvers guide and direct the rainwater to collection points where the water is transferred to a filtration system. The filtered water may then be stored for subsequent use within the building. The collected water may be used multiple times within the building by incorporation of an interior water treatment system. The treatment system may treat the water to desired levels for subsequent potable and non-potable uses.

Other features and advantages of the present invention will become apparent from a review of the following detailed description taken in conjunction with the drawings.

DETAILED DESCRIPTION

Figure 1:
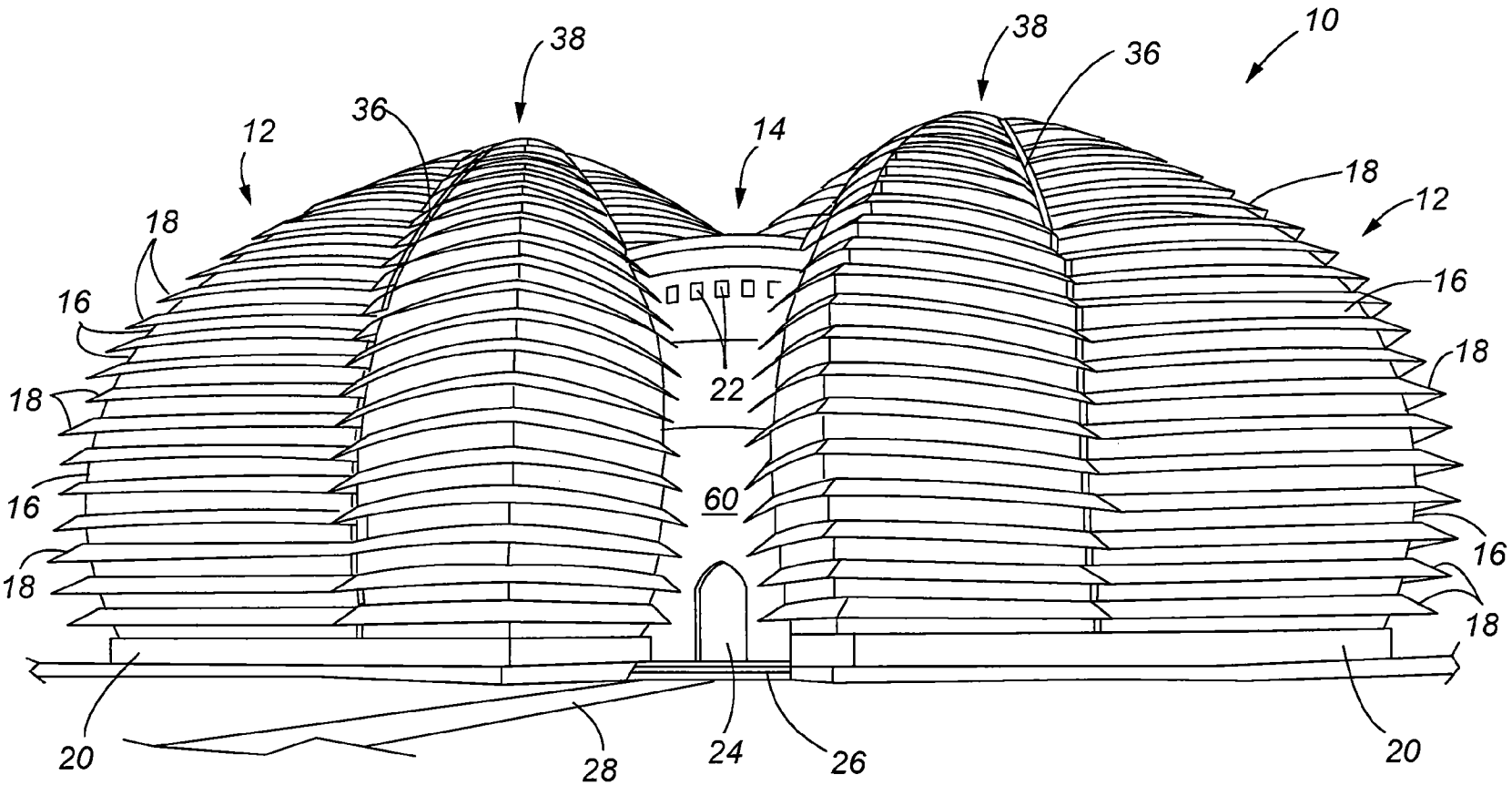
FIG. 1 is a perspective view of the building with integrated natural systems of the present invention.
Figure 2:
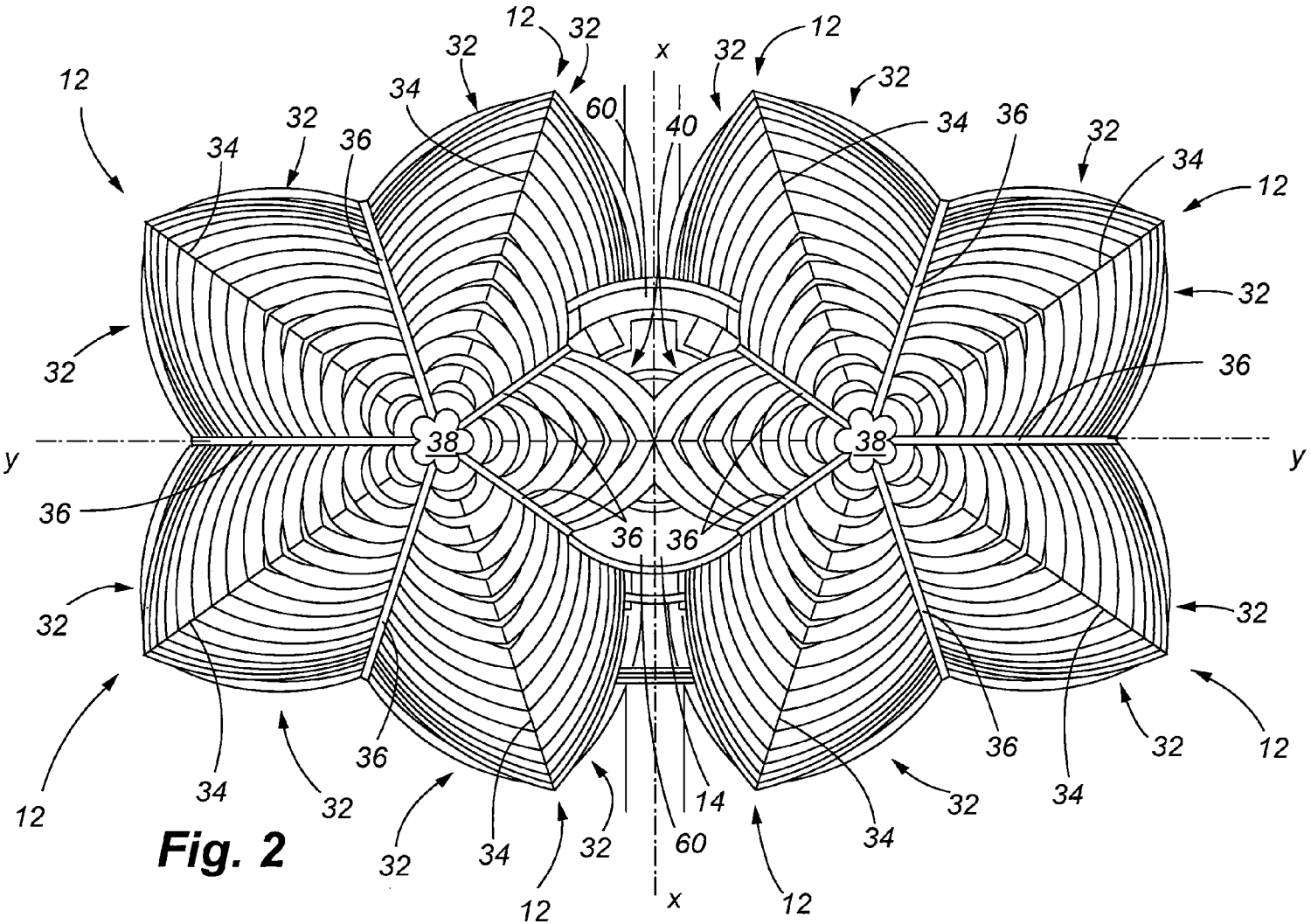
FIG. 2 is a plan view of the building.
Figure 3:
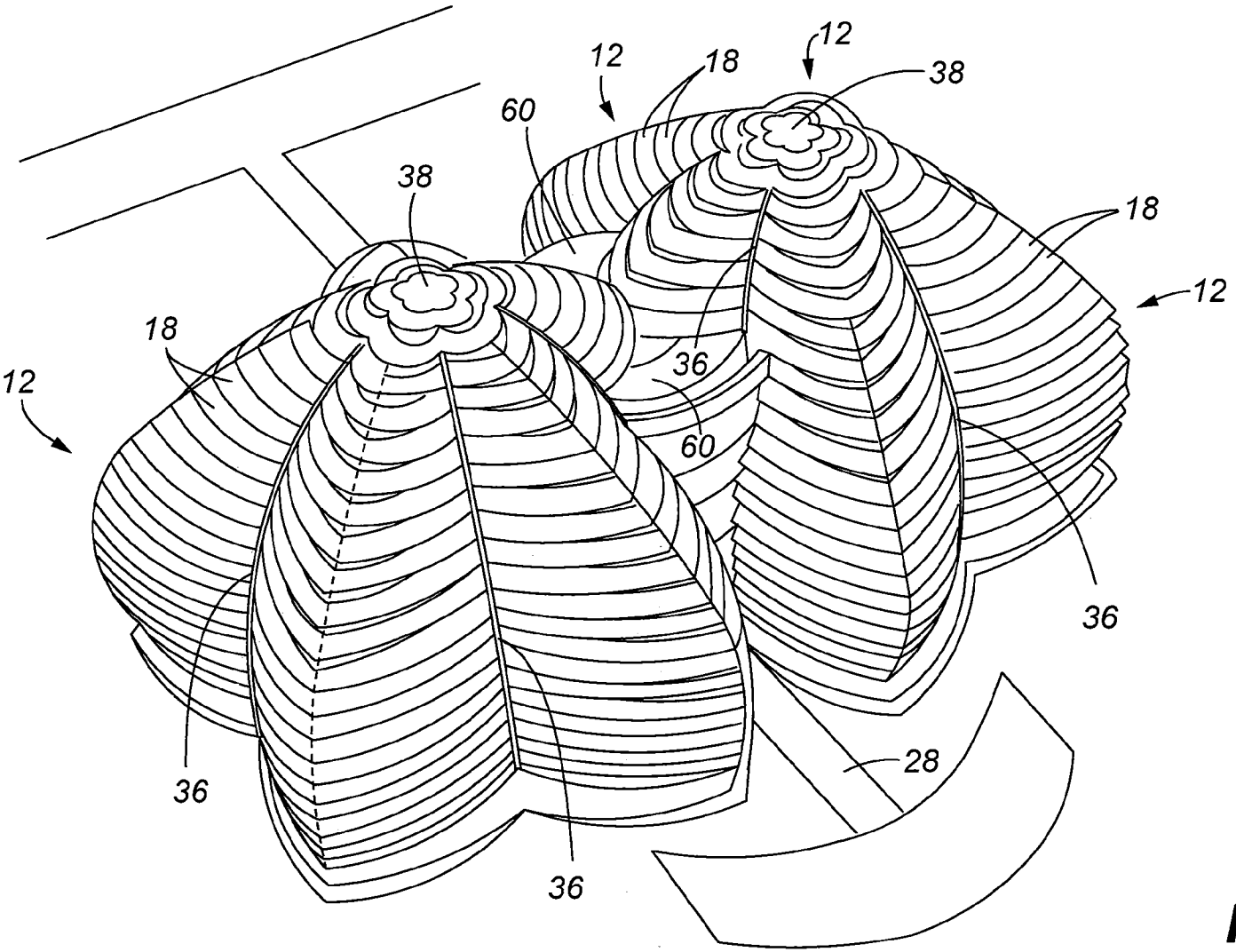
FIG. 3 is another perspective view of the building.

FIGS. 1-3 illustrate the building with the integrated natural systems in accordance with a preferred embodiment of the present invention. The building 10 is characterized as a complex-shaped structure having a plurality of curved exterior sections 12. Each of the curved exterior sections 12 include a pair of symmetrical extensions 32 that are joined along a crest or ridge line 34. The building is further characterized as having two groups of the curved exterior sections 12 interconnected by a pair of central facing curved exterior sections 40, as best seen in FIG. 2. The curved exterior sections 12 are connected to one another in a circumferential fashion and are joined along receding areas or troughs. Rain collection gutters 36 are located in these receding areas. When viewed as from the plan view of FIG. 2, the two groups of exterior sections 12 each form shapes that have a center or apex 38. As shown from the plan view of FIG. 2, the rain collection gutters 36 each extend radially outward from the apexes 38. The rain collection gutters 36 form part of the rain water collection system as described further below with respect to FIG. 9. Two habitable spaces of an interior structure or core 14 are oriented under the groups of exterior sections 12, while a central tower 60 is located between the habitable spaces and under the central facing exterior sections 40, as discussed in more detail below in reference to FIG. 4. The central tower may be constructed of thickened masonry walls, stone, or adobe materials.

Referring specifically to FIG. 1, it is seen that each of the crests 34 have one end that intersects with the corresponding apex 38, and the crests 34 each extend downwardly and outwardly forming a generally convex curved shape. The lower ends of the crests 34 terminate at a foundation 20 of the building (see FIG. 4). A plurality of louvers 18 are mounted to the exterior cover of the building as shown. The louvers are arranged in a plurality of horizontally extending rows, and each of the rows between each of the curved exterior sections 12 are aligned at the same elevation therefore providing a generally uniform series of horizontally extending rows that are spaced vertically along substantially the entire height of the building. When viewing the louvers from the plan view of FIG. 2, it is shown that the louvers substantially cover the entire exterior cover of the building. The curved shape of the exterior cover enhances the number of rows of louvers that can be attached directly to the building thereby also enhancing the power generation capability of the building.

Figure 4:
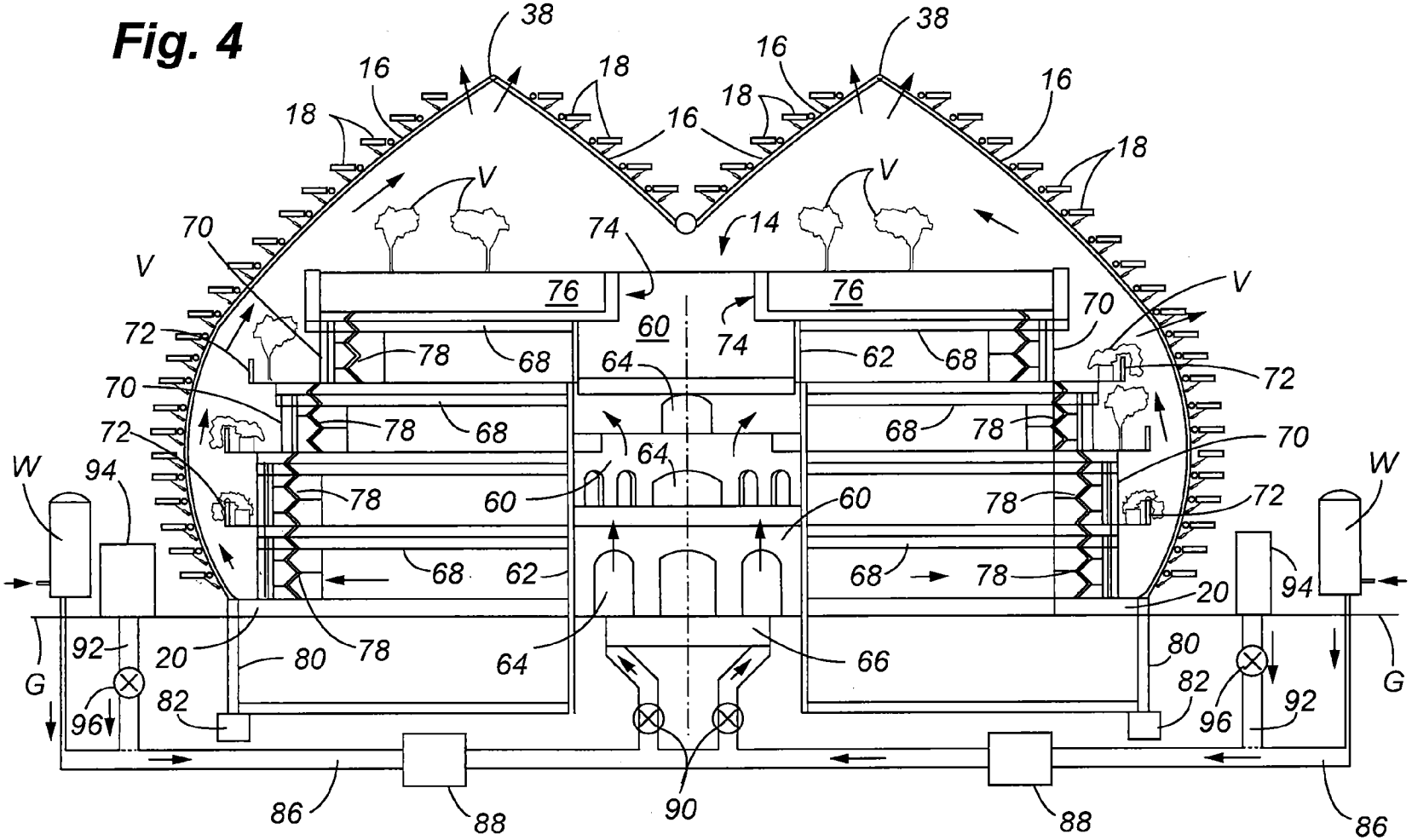
FIG. 4 is a cross-sectional elevation view of the building.

Referring to FIG. 4, the exterior cover is defined by a curved-shaped shell or layer 16. Within the shell 16 resides the interior structure or core 14 that forms the habitable space for users. More specifically, the interior structure or building core 14 includes a central tower 60 disposed between two lateral wings of habitable living spaces. The living spaces each include a plurality of floors 68 and enclosing walls 70. As shown in FIGS. 1 and 3, a portion of the core 14 is exposed, while the lateral wings of the core 14 are housed within the exterior cover or shell 16. As best seen in FIG. 1, the core 14 may include a plurality of core windows 22, an entrance 24, stairs 26 and a walkway 28.

The central tower 60 is defined by walls 62 forming a cylindrical-shaped edifice. A plurality of ports or openings 64 in the walls 62 enable users to travel between the floors 68 of the living spaces located on opposites sides of the core. The enclosing walls 70 of the interior structure may also include a plurality of windows/window panels in order to selectively distribute light into the habitable spaces within the interior structure. One or more staircases 78 may be located between the floors enabling access between the floors. In the preferred embodiment of FIG. 4, a pair of stairwells 78 is located at opposite sides of the interior structure.

A plurality of planters 72 may be formed as extensions of the various floors 68 for planting and cultivating vegetation. The roof or upper floor of the interior structure may include an arboretum 74 that has larger vegetation grown thereon to include trees and shrubbery. The most upper floor 68 and arboretum sidewalls 76 form containment areas for the arboretum.

Depending upon where the building is located, a foundation 20 may extend below the surface of the ground G, and can also provide additional habitable space in the form of a basement. A plurality of subsurface supports 80 such as pilings may be used to support the exterior cover layer. The pilings 80 may be used in conjunction with footers 82 to provide adequate stabilization for the overhead superstructure.

The lower portion of the core 14 within the tower 60 may incorporate an integral subsurface water storage facility 66. For aesthetic purposes, the water storage facility 66 can be formed in a cylindrical shape, thus resembling a well. Ornamental aspects may be added to the well to include a fountain if desired. The water storage facility 66 receives its water from either an external water supply and/or water that is collected by a rainwater collection system incorporated on the exterior structural layer of the building, as discussed in more detail in reference to FIG. 9. FIG. 4 more specifically illustrates the water storage facility 66 receiving water from an external water source W which may or may not be a potable water source. As necessary, a water treatment element (not shown) may be used to treat the incoming flow of water from the water source W. The water then travels through one or more subsurface channels or pipes 86 and carries the water to the water storage 66. As necessary, one or more fluidic pumps 88 may provide adequate force for transfer of the water to the water storage facility 66. One or more check valves 90 may be provided to prevent backflow of water once it has been transported into the water storage 66.

In addition to subsurface pipes that carry water to the water storage 66, additional air pipes or conduits 92 may be incorporated for transporting a flow of air from the environment through the subsurface air pipes 92 into the building. The air pipes 92 as shown in FIG. 4 communicate with an air handling device, such as air filtration devices 94. The air pipes 92 may communicate directly with the water pipes 86, or the air pipes 92 may be separate and independently traverse through the ground and into the building core 14 adjacent the water storage 66. In the example of FIG. 4, the air lines 92 connect to the respective water pipes 86. Check valves 96 may also be used to prevent a backflow of water in the event of an excess amount of water contained within the water storage 66 backs up through pipes 86. The passage of the air and water through an underground series of passageways allows the ground to act as a heat exchanger in which the water and air is heated/cooled to a temperature which more closely matches that of the subsurface ground. In desert regions, this is particularly advantageous in that both air and water from ambient conditions will have a much higher temperature and effective cooling of the air and water can occur by the system of pipes. Similarly, in arctic conditions, air and water may be effectively heated by passage of the air and water through the subsurface pipe systems.

The directional arrows in FIG. 4 illustrate the flow path of air through the building in which the air enters the building through the building core 14 adjacent the water storage 66. The air is then transferred radially outward from the building core into the habitable spaces between floors 68. Vents or windows 71 provided on the enclosing walls 70 (See FIGS. 5 and 6) allow the air to flow upwards in the greenhouse space between the interior structure and the exterior cover, and ultimately the air may exit the exterior cover through vents (not shown) formed at the apexes 38.

In viewing the building from FIG. 2, it is shown that the building is symmetrical about two axes, namely the axis Y-Y and the axis X-X. The symmetry along the X-X axis enables the building have two functional halves. Each half may serve a different purpose for the inhabitants, or be used to segregate inhabitants/users. For example, if the building was to be used as a spa, one half of the interior building could be used for men, the other half for women, and the central tower 60 could be used as a central gathering place. Further for example, if the building were to be used as a home, one side or half of the building could be used for bedrooms and sleeping quarters, while the other half could be used for recreational areas, kitchens, or other specific uses. Again, the central tower 60 could be used as a central gathering or interaction area.

Figure 5:
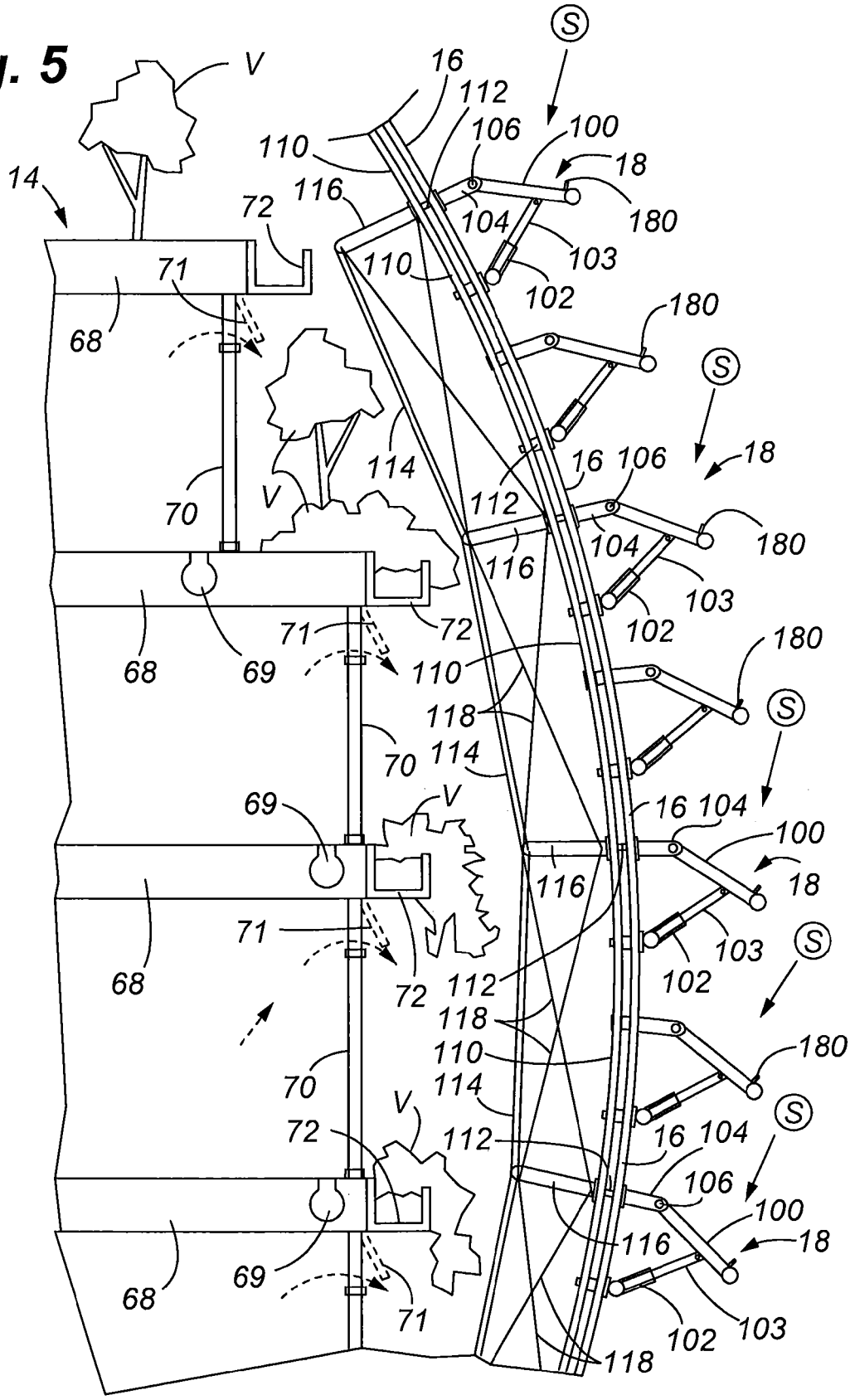
FIG. 5 is an enlarged fragmentary cross-sectional view of the building showing details of the exterior cover and solar panels.

Referring to FIG. 5, additional construction details are provided for the interior building structure, the exterior cover and the louvers. Referring first to the exterior cover 16, the plurality of louvers 18 are shown in their mounted position along the curvature of the exterior cover 16. As shown, the louvers can also provide a significant degree of shade for the underlying interior structure. The louvers each include a main panel 100, a telescopic actuator 102 and a base support or base mount 104. The main panel 100 is rotatable about a hinge/pin 106 and the telescoping actuator 102 has a telescoping element 103 that may be retracted or extended to angularly position the panel 100. FIG. 5 illustrates the louvers 18 in a position to capture sunlight, the sunlight shown as the directional arrows S.

FIG. 5 also illustrates a truss support for supporting the exteriorly mounted louvers 18. This truss support includes a main abutting support member 110 that substantially parallels the exterior cover 16. The support member 110 may comprise a plurality of a structural steel or aluminum beams that are curved to match the shape of the exterior cover 16. A plurality of interconnecting rods 112 are used to mount the louvers 18 to the exterior cover 16 as shown. The rods 112 pass through openings in the exterior cover 16 and are secured to the support member 110 as shown.

The truss support further includes an interior truss member 114 that extends into the greenhouse space. Orthogonal truss extensions 116 interconnect the main support member 110 and the interior truss member 114. The truss support may include a plurality of interconnecting cables or rods 118 that provide the necessary support between the main support member 110 and the interior truss member 114. As shown in FIG. 4, the lower ends of the truss support and the exterior cover 16 may be supported by the piles 80, as shown in FIG. 4. A plurality of spaced truss supports can be mounted to locations along the interior surface of the cover 16, and the number of supports and their spacing to one another can be altered to provide the necessary support for the particular arrangement of louvers 18 incorporated on the exterior cover 16.

Figure 6:
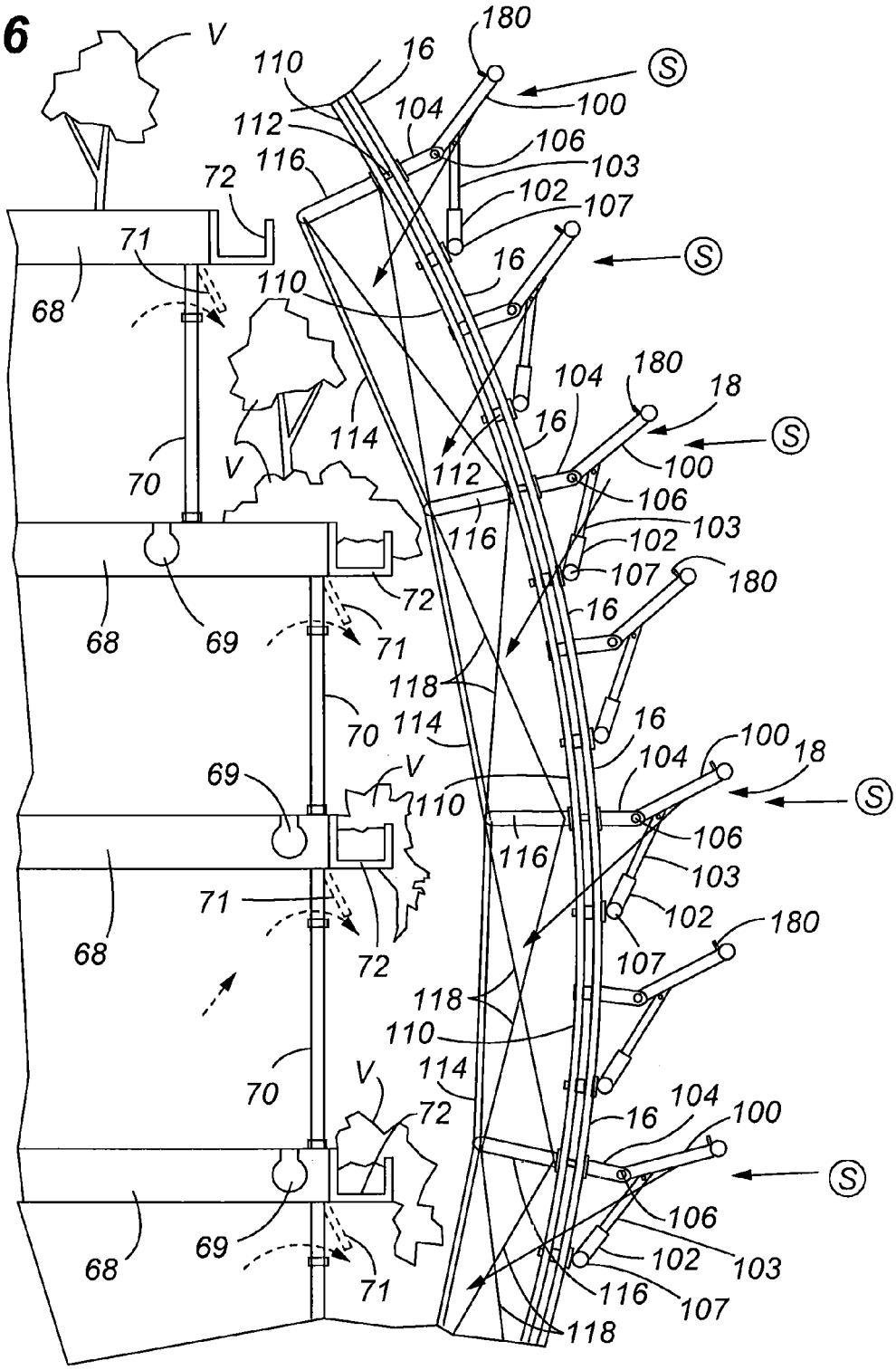
FIG. 6 is another enlarged fragmentary cross sectional view showing the solar panels in a different position.

Referring to FIG. 6, the telescoping elements 102 have been extended such that the lower surfaces of the main panels 100 are exposed. These lower surfaces may be coated with a reflective surface. In this position, assuming the sunlight is generally in the direction as shown by the directional arrows S, the louvers are capable of directing sunlight within the interior of the structure. In order to place the louvers 18 in the position shown in FIG. 6, it is also contemplated that the louver assembly may have a rotatable connection for the telescoping element 102 shown as rotatable connection 107. Thus, the telescoping element 102 could be placed in two distinct positions functional, one position being that shown in FIG. 5 for capturing sunlight on the upper surfaces of the louvers, and second being shown in FIG. 6 for capturing sunlight on the lower surfaces of the louvers. It shall be understood that the louvers may be incrementally positioned at any angle to best capture sunlight on either the upper or lower surfaces of the louvers to best accommodate power generation, interior lighting, or combinations of the two.

Referring again to FIGS. 5 and 6, additional detail is shown for the planters 72 that may be incorporated adjacent the enclosing walls 70 of the interior structure. The planters 72 may be suitable for growing vine-like plants, smaller bushes or other vegetation. The enclosing walls 70 may include the vents 71 that enable the flow of air into the greenhouse space. FIGS. 5 and 6 also show floor mounted plenums 69 that communicate with the building core 14 providing air into the habitable spaces between the floors 68.

The truss structure may be constructed of a rigid aluminum tubular frame system configured as a grid/matrix as shown. The exterior cover may be a transparent polymer, such as ethylenetetraflowro-ethylene (ETFE). This thin film makes the interior airspace relatively air tight. The louvers may be constructed of tempered glass that may be opaque, translucent, fritted or clear depending upon the desired light transmission. If the louvers are to support PV panels, then the louvers may include an underlying frame which supports the PV panel portions. It is also contemplated that the louvers can be a combined construction in which one portion thereof is made of a tempered glass and the other portion includes a PV panel. Additionally, the louvers could be constructed of sheet metal, either solid or perforated, which would therefore reflect or allow at least some light transmission therethrough. It is also contemplated that in some orientations of the building, the upper and/or lower surfaces of the louvers can act as a light shelf and, therefore, may have white/reflective coatings to direct light into the building interior. FIG. 6 is an example of in which a reflective coating could be applied to the lower surfaces of the louvers in order to enhance sunlight transmission into the building.

Figure 7:
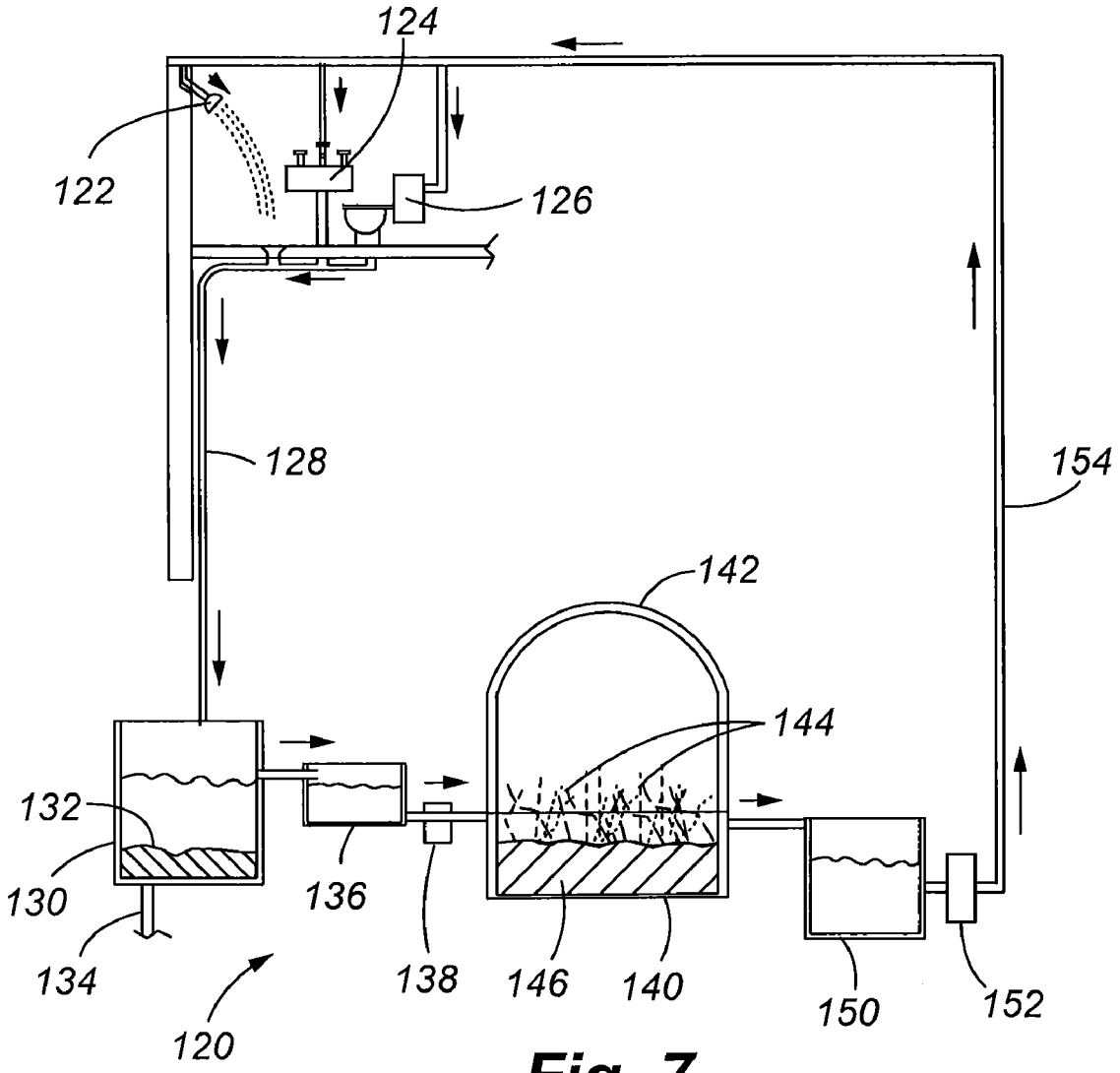
FIG. 7 is a schematic diagram of a water treatment system for treating water for re-use with the building.

Referring to FIG. 7, a treatment system 120 is provided to treat water for non-potable uses. A multi-stage process is used to generate water that can be re-used, for example, in a bathroom in which a shower 122, a sink 124 and a toilet 126 are found. A first step in the process is to direct the waste water through waste line 128 to a solids settling tank 130 where solids can be captured. As shown, solids 132 settle to the bottom of the tank, and can be removed by solids line 134. The water from the settling tank 130 is released into a dosing tank 136 of a desired volume. The water from the dosing tank 136 is then metered into a treatment station 140 as by pump 138. The treatment station 140 operates to clean the water to a degree so that it can be returned to the bathroom for re-use as non-potable water. The treatment station 140 preferably takes advantage of various biological processes to treat the water. For example, the station 140 may contain microbes to treat the water both aerobically and anaerobically. The station may include a biofilter material 146 that filters the water and may also function as a medium to grow plants 144 that also assist in bio-remediation of the water. The station 140 may simulate, for example, a wetlands area in which the combination of plants, microbes, and filter material (soil/sand) act together to treat the water. The station 140 may be located within the greenhouse space between the building core 14 and the exterior cover 16. Preferably, the station 140 has a transparent cover 142 that prevents escape of odors and also enhances plant and microbial growth in a greenhouse environment. Depending upon space available and the size of the station 140, it is also contemplated that the station 140 could be placed outside of the building. The treated water is then conveyed to storage, shown as a gray water storage tank 150. The treated water may then be returned to the bathroom via pump 152 and return line 154. Although the system 120 is shown as a closed loop, it shall be understood that some amount of water will be lost in solids removal and therefore, some amount of water is necessary to replace the lost water.

Figure 8:
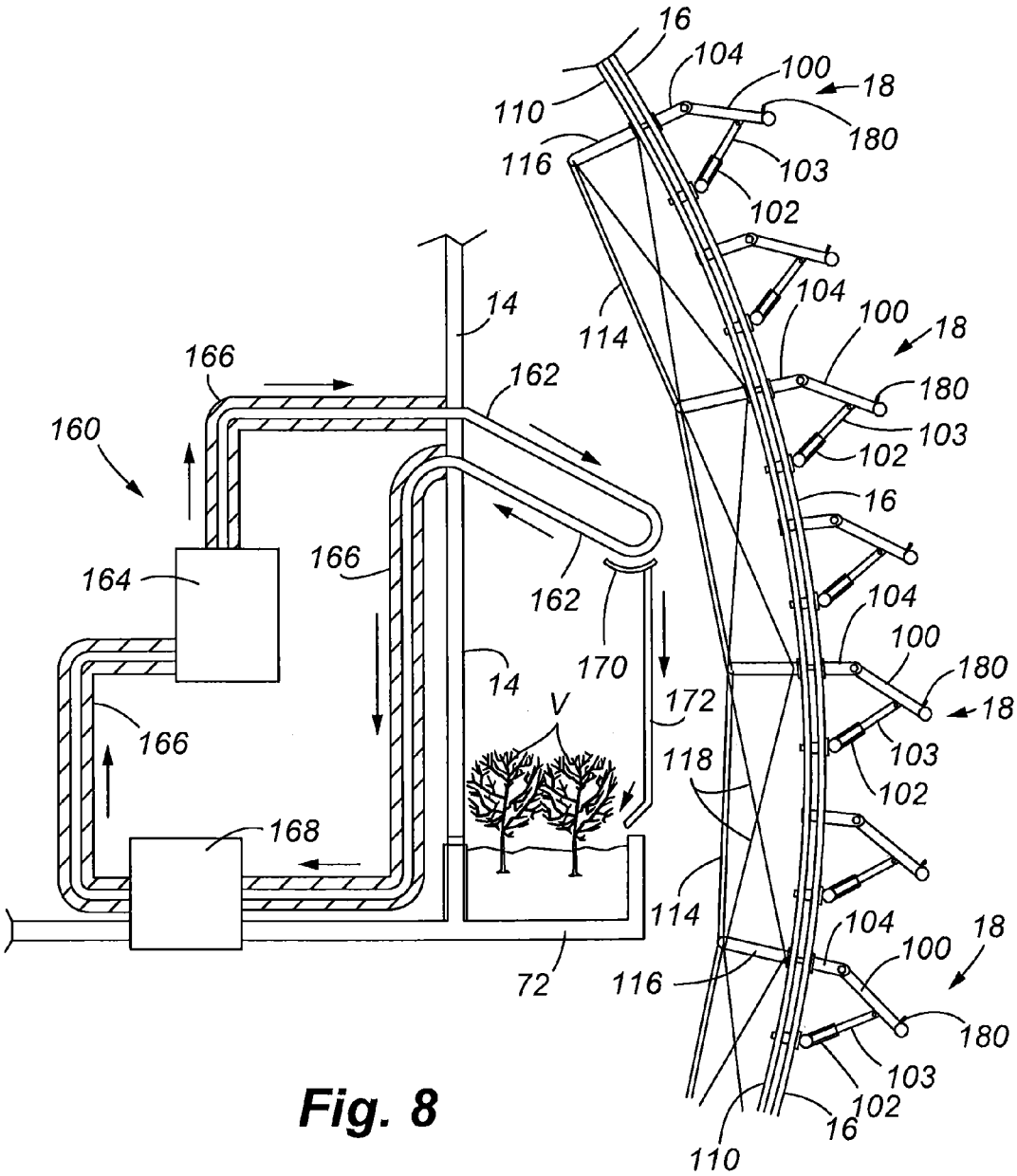
FIG. 8 is a schematic diagram of an interior water collection and humidity control system.

Referring to FIG. 8, an internal water recovery and humidity control system 160 is illustrated. The system 160 includes an exposed condensing line 162 that is maintained at a temperature to condense water vapor in the air. The collected liquid water may then be used to water vegetation V, or may otherwise be collected for re-use within the building. As shown, the system 160 comprises a chiller 164 that functions to chill a cooling medium, such as glycol, that is circulated through an insulated delivery line 166. When the line 166 reaches the air in the greenhouse space between the core 14 and the exterior cover 16, the line is exposed by removing the insulation and thus defines a condensing line 162 that maximizes heat transfer to condense water vapor in the air. The cooling medium flows back into the core 14 by the insulated return line 166. Depending upon the temperature of the return line 166, it can be used to either supplement heating or cooling of the airspace within the core 14. In order to pre-cool the heated cooling medium in the return line 166, a cooling fan 168 can be incorporated prior to the cooling medium returning to the chiller 164. As also shown in FIG. 8, the condensing line 162 is oriented to collect water so that the collected water flows into a receptacle 170, and receptacle 170 connects to drip line 172 which is used to water the vegetation V. Other drip/collection lines can be used to collect the liquid for transport to a desired use within the building. Under particularly humid conditions, the system 160 can be effective to de-humidify the air. One or more condensing lines 162 may be positioned to water vegetation or otherwise collect water for transport to a desired use.

Figure 9:
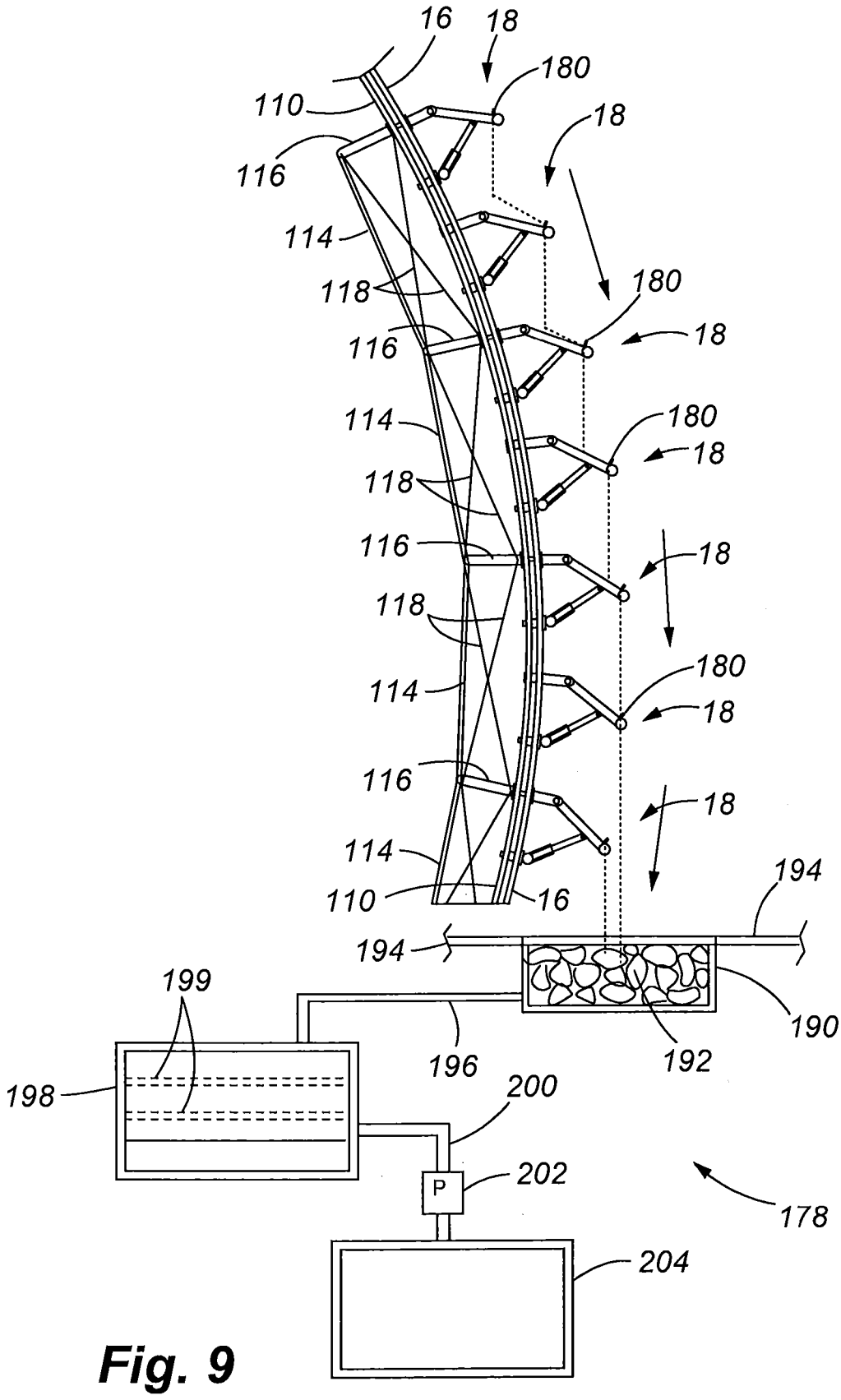
FIG. 9 is a schematic diagram of an exterior rainwater collection system.

Referring to FIG. 9, an external rain water collection system 178 is illustrated. The collection system 178 includes a plurality of horizontally oriented rain collection flanges 180 (also shown in FIGS. 6 and 8), that are mounted to the free ends of the panels 100. The flanges preferably extend along the horizontal length of the free ends, and therefore provide the appearance of the panels 100 having upturned ends. The flanges 180 are oriented in this upturned fashion to create a rain collection trough or channel on each of the panels 100. The flanges 180 intersect at each end with a corresponding vertically oriented rain collection gutter 36. Water is collected on the panels 100 and is directed by the rainwater troughs to the rain collection gutters 36. The gutters 36 communicate with inlet transfer pipes 194 that convey the water to one or more rainwater collection receptacles 190. The receptacles 190 achieve two primary purposes: to collect the rain water in a central location and to provide initial filtration for the collected water. For filtration, the receptacles 190 each include one or more types of gravel and porous fabric layers placed between layers of gravel. The combination of gravel and fabric layers provides coarse filtration to remove larger particle contaminants. The coarsely filtered water is then transported by conveying line 196 to a main filtration station 198. Within the filtration station 198 are a plurality of selected materials for filtration, shown as filter layers 199. In order to encourage high output of water through the main filtration station 198, a downstream pump 202 in line 200 draws the filtered water to a temporary storage location within tank 204. From the tank 204, the water can then be transported for further filtration/treatment (e.g., for creating potable water), or the filtered water in tank 204 can be directly used for grey water applications within the structure, for example as a supply of water for plants and/or water for use in bathrooms.

It is also illustrated in FIG. 9 that the panels 100 are positioned so that excess water that overfills the troughs is received in the next lower level trough, and this repeated overflow pattern is achieved so that the overflow water reaches the most lower level panel 100 that is centered over the collection receptacle. It may be advantageous to encourage the flow of rainwater in this cascading fashion by minimizing the height of the flanges or the angle at which the flanges 180 extend from the free ends of the panels. The cascading water in this manner becomes oxygenated that may assist in purification of the water. In any event, the water can be directed in the cascading fashion and/or through the vertically oriented gutters 36 for collection into the receptacles 190. The receptacles 190 extend along selected lengths of the structure in order to receive cascading water from all or selected portions of the panels 100.

In summary, the central tower 60 of the core forms an open vertical area for enabling air to circulate between the floors. The size of the airspace within the central core acts as a thermal mass in which the large open airspace helps to further modulate or regulate the interior air temperature between the floors. The central tower of the building is built around a central water storage facility in the form of a well which may incorporate a fountain. The water may be continuously circulated by pumps within the well casing to humidify the air traveling upward through the core. The interior building construction may include floors constructed of concrete slabs over steel decking and supported by steel post and beam construction. The enclosing walls 70 located at the perimeters of the floors may be frame construction resting on the floors or curtain wall constructions attached to the floors. The enclosing walls may further include operable glass panels and doors as well as doors that open to the greenhouse space between the enclosing walls and exterior cover.

The greenhouse space provides an area for growing vegetation, and planters and an arboretum may be incorporated in this greenhouse space. A drip irrigation system (not shown) can also provide water to the roots of the plants to minimize water use. The arboretum may be structurally supported by a reinforced steel beam pattern located on the roof in order to better carry the load of the additional weight of the soil necessary for the arboretum to grow larger plants, such as trees. A water proofing system (not shown) can be used to include waterproof liners and drainage systems in order to keep the lower levels dry and isolated as between the arboretum and planter boxes. The water proofing system may include several layers of materials to enable irrigation of the vegetation and drainage of excess water. For example, a fabric layer can be used under the soil, and then one or more impermeable layers can be used to direct the excess water to a water storage tank. The fabric layer allows passage of water but not soil. The impermeable layers may include a drain mat that collects the water and directs it to a storage tank. Another underlying impermeable protection layer can be placed under the drain mat to protect the above disposed layers.

It is also contemplated within the present invention to provide a central control system in order to provide a user with convenient way in which to monitor, adjust, and otherwise control the natural systems incorporated within the building's structure. The control system would include temperature and humidity monitoring devices provided as inputs to a central controller. The user can program the central controller in order to establish desired temperature and humidity conditions within the habitable space within the interior structure, as well as temperature and humidity conditions for the greenhouse space. For example, assuming ambient temperature conditions are very high, the louvers 18 can be adjusted to provide maximum shade based upon the position of the sun, and an increased flow rate of air within the structure could be provided to provide better air exchange for cooling of the interior. In yet another example, assuming ambient temperature conditions were very cold, the louvers 18 could be positioned to allow maximum penetration of sunlight with minimal shading by the louvers 18. For humidity control, it is also contemplated that the water recovery/humidity control system 160 can be controlled with the central control system to set the air at a desired humidity. With respect to production of electrical power by the solar panels incorporated on the louvers, it is also contemplated that the present invention may include an electrical storage capacity for storing electrical energy generated by the solar panels.

The natural systems incorporated in the present invention provide a number of functional and sustainable advantages. One of the natural systems may be identified as use of solar energy to power the building, such as to produce heat, cooling or to power other electrical equipment such as lighting. Selected ones or all of the louvers 18 may incorporate photovoltaic (PV) panels which provide power to the building. Additionally, the louvers may incorporate reflective surfaces for purposes of transmitting sunlight into the interior of the building, and more specifically to act as a source of light in lieu of electrical lighting. One unique combination may include the provision of PV panels on the upper surfaces of the panels, with reflective material on the lower surfaces of the louvers. As described with respect to the FIGS. 5 and 6, the louvers 18 may be selectively positioned such that the upper and lower surfaces of the louvers are capable of capturing sunlight and/or reflecting light into the interior of the building.

Another natural system of the present invention includes the ability to regulate air temperature within the building by provision of the subsurface air pipes that are used to regulate the temperature of air introduced into the building. Using the ground as the primary heat exchanger eliminates significant capacity otherwise required for a traditional HVAC system. Similarly, the water which is regulated by contact with the subsurface ground also acts as a natural system to humidify the air passing through the piping system, as well as to provide an aesthetically pleasing central well is located within the building core.

There are a number of advantages to the present invention. Heating, cooling and power are provided to the building by complementing features which each reduce the dependency of the building on exterior resources. The extensive array of louvers can provide an increased amount of power as opposed to traditional solar panels which are only roof mounted. The louvers can also be used for purposes of shading as well as to act as a light shelf in order to direct light into the interior of the building. Using the temperature of the subsurface ground as a heat exchanger, both incoming air and water may be temperature regulated to maintain the desired temperature of the interior airspace within the structure. A collection of rainwater can be used for many purposes to include not only the well which helps humidify the air, but also as a potable source by inclusion of a small water treatment facility within the building.

Air is evacuated from the building at the most upper portion, which facilitates a continual circulation of air upwards through the building structure. Air can be most optimally circulated and evacuated through a series of blowers or fans which can be located within selected locations within the greenhouse space as well as within the interior building structure. For example, it is contemplated that one or more fans/blowers may be mounted to the truss structure at the openings located at the apexes 38 in order to provide an upward flow of air through the greenhouse space. The blowers/fans can be sized and located at the appropriate conditions based upon where the building is installed to accommodate the necessary flow of air through the interior of the building structure into the greenhouse space to accommodate desired temperatures and humidity. While the present invention has been described with respect to one or more preferred embodiments, it shall be understood that various other modifications and changes may be adopted commensurate with the scope of the claims appended hereto.

What is claimed is:

1. A building comprising:

a curved exterior covering formed of an impermeable skin or membrane, said covering being made of one of a substantially translucent or clear material enabling passage of sunlight;

an interior structure disposed in an open area covered by said exterior covering;

a plurality of louvers mounted to and spaced from said covering, said louvers being arranged in a plurality of rows and said rows being spaced vertically along said covering;

an actuator for mounting each of said louvers to said curved exterior covering, and for angularly positioning each of said louvers;

at least one point of rotation about which said louvers are rotatable;

at least one of said louvers having photovoltaic cells incorporated thereon for production of electricity;

a truss support secured to said curved exterior covering for supporting said curved exterior covering, said truss support extending vertically along and adjacent to said curved exterior covering; and said interior structure comprising an enclosing wall and a plurality of floors, and habitable space in the interior structure formed by space within the interior structure between said floors and said enclosing wall.

2. The building, as claimed in claim 1, wherein:

a first subsurface passageway for carrying air from an environment outside of said covering to the open area within the covering;

a second subsurface passageway for carrying water from a water source collected outside of said covering and for transporting the water to a water storage element within the interior structure; and said interior structure further comprises a central core separating said enclosing wall and said floors, said central core communicating with said first and second subsurface passageways for receiving the water and air.

3. The building, as claimed in claim 2, wherein:

said central core comprises a cylindrical-shaped tower having a plurality of ports enabling users to travel between said floors located on opposite sides of the core.

4. The building, as claimed in claim 1, further including:

a water treatment system for treating water for reuse within the building, said water treatment system including: a solids settling tank, a dosing tank, a treatment station, and a storage tank, treated water being held in said storage tank and transported for reuse within said building.

5. The building, as claimed in claim 1, further including:

an interior water collection and humidity control system including a condensing line for condensing water vapor for collection, a chiller for cooling fluid passing through said condensing line, and a cooling fan for cooling the fluid after being heated by exposure within said condensing line.

6. The building, as claimed in claim 1, further including:

an exterior rainwater collection system, said exterior rainwater collection system including a plurality of rainwater diverters secured to said louvers to create respective channels for collecting rainwater that strikes said louvers, at least one rainwater collection receptacle for receiving the collected rainwater from said respective channels, at least one filter element in said receptacle for filtering the collected rainwater, and a storage tank for storing the rainwater from said receptacle.

7. The building, as claimed in claim 6, wherein:

said rainwater collection system further includes a plurality of gutters disposed on the exterior covering, said gutters for receiving water collected from said rainwater diverters and for transporting the collected rainwater to said rainwater collection receptacle.

8. The building, as claimed in claim 1, further including:

a plurality of planters incorporated in the floors for growing vegetation.

9. The building, as claimed in claim 1, further including:

an arboretum located on a most upper floor of said interior structure for growing vegetation.

10. The building, as claimed in claim 1, wherein:

a gap located between said interior structure and said exterior covering form a greenhouse space.

11. The building, as claimed in claim 1, wherein:

said enclosing wall comprises a plurality of windows for facilitating transfer of sunlight into the interior of said interior structure.

12. The building, as claimed in claim 1, wherein:

said louvers are selectively positionable about two points of rotation.

13. The building, as claimed in claim 1, wherein:

said curved exterior covering comprises a plurality of curved exterior sections, and each of the curved exterior sections includes a pair of symmetrical extensions joined along a corresponding ridgeline.

14. The building, as claimed in claim 13, wherein:

said curved exterior sections are arranged in two groups interconnected by a pair of facing curved exterior sections.

15. The building, as claimed in claim 13, wherein:

each of said curved exterior sections forms shapes that have an apex constituting a most upper portion of the exterior sections.

16. The building, as claimed in claim 13, wherein:

each of the ridgelines has one end that intersects with an apex, and the ridgelines extend downwardly and outwardly forming a generally convex curved-shape.

* * * * *